US005689771A

United States Patent [19]

Sato et al.

[11] Patent Number: 5,689,771

[45] Date of Patent: Nov. 18, 1997

[54] COLOR IMAGE FORMING APPARATUS HAVING BIAS CONTROLLER FOR CLEANING TRANSFER ROLLER

[75] Inventors: Kazuhiko Sato; Shigeki Takenouchi, both of Hachioji, Japan

[73] Assignee: Konica Corporation, Tokyo, Japan

[21] Appl. No.: 606,365

[22] Filed: Feb. 23, 1996

[30] Foreign Application Priority Data

Mar. 2, 1995 [JP] Japan ..... 7-066657
Mar. 14, 1995 [JP] Japan ..... 7-054287

[51] Int. Cl.[6] ..... G03G 15/16

[52] U.S. Cl. ..... 399/101

[58] Field of Search ..... 355/219, 271, 355/273, 274, 277; 399/231, 298, 313, 314, 101

[56] References Cited

U.S. PATENT DOCUMENTS

| | | | |
|---|---|---|---|
| 5,079,597 | 1/1992 | Maaer | 355/303 |
| 5,132,738 | 7/1992 | Nakamura et al. | 355/274 |
| 5,153,654 | 10/1992 | Yuminamochi et al. | 355/277 |
| 5,182,604 | 1/1993 | Asai | 355/273 |
| 5,253,022 | 10/1993 | Takeuchi et al. | 355/274 |
| 5,287,149 | 2/1994 | Hoshika | 355/246 |
| 5,331,383 | 7/1994 | Nou et al. | 355/274 |
| 5,337,127 | 8/1994 | Imaue | 355/271 |
| 5,420,668 | 5/1995 | Okano | 355/206 |

*Primary Examiner*—Robert Beatty
*Attorney, Agent, or Firm*—Frishauf, Holtz, Goodman, Langer & Chick, P.C.

[57] ABSTRACT

A color toner image forming apparatus comprises a transferring roller having an average cell diameter of 1 μm to 300 μm to transfer a toner image from a photoreceptor drum to a sheet. During the transferring operation, the electric bias member applies onto the transferring roller an opposite electric bias of a constant current having the opposite electric polarity to that of the toner image, and during a cleaning operation to shift toner adhered on the transferring member to the photoreceptor, the electric bias member applies onto the transferring member alternately an identical electric bias of a constant voltage having the identical electric polarity with that of the toner image and an opposite electric bias of a constant current having the opposite electric polarity to that of the toner image six times or more.

12 Claims, 11 Drawing Sheets

TRANSFER ROLLER A

TRANSFER ROLLER B

TRANSFER ROLLER C

TRANSFER ROLLER D

TRANSFER ROLLER E

COLOR IMAGE FORMING APPARATUS HAVING BIAS CONTROLLER FOR CLEANING TRANSFER ROLLER

BACKGROUND OF THE INVENTION

The present invention relates to an image forming apparatus employing an electrostatic transfer technology such as an electrostatic copying machine and an electrostatic printer, and in particular, to a color image forming apparatus wherein a color image is transferred onto a recording sheet through utilization of a contact transfer means based on pressure of a pressure transfer roller or the like, and at least two toner images each being monochromatic are superposed on an image carrier.

In an electrostatic copying machine and an electrostatic printer employing an electrophotography technology, a corona discharge unit has been used widely in a charging/transfer unit. However, the corona discharge unit requires high voltage of 5–10 KV to be impressed, which causes a problem of ozone generated through electric discharge. In recent years, therefore, a contact charging method and a transfer roller method which are aiming at a low voltage and ozone-free system are attracting public attention as a substitutive technology.

The transfer roller method has been put to practical use recently because of its advantages that an amount of generated ozone is less compared with transfer by means of conventional corona discharge and it is free from uneven transfer caused by contaminated corona wires.

Japanese Patented Publication No. 33494/1977 and Japanese Patent Publication Open to Public Inspection Nos. 19456/1975, 45344/1977 and 123385/1990 (hereinafter referred to as Japanese Patent O.P.I Publication) are given as a known technology for controlling current and voltage in the transfer roller method.

Further, Japanese Patent O.P.I. Publication No. 244081/1990 discloses a technology wherein, in a transfer roller method, transfer bias voltage having polarity opposite to that of toner to be transferred onto a recording sheet is impressed on a transfer roller when the recording sheet is present between an image carrier and a transfer roller, while transfer bias voltage having polarity identical to that of the toner is impressed on a transfer roller when the recording sheet is not present at a transfer roller, Further, Japanese Patent O.P.I. Publication No. 27605/1993 discloses a technology wherein, in a transfer roller method, polarity of bias voltage for cleaning is switched alternately between a positive polarity and a negative polarity in the course of cleaning transfer rollers.

Further, Japanese Patent O.P.I. Publication No. 51654/1994 discloses a technology wherein, in a transfer roller method, polarity of bias voltage for cleaning is switched alternately between a positive polarity and a negative polarity depending on how a recording sheet passes through a gap between an image carrier and a transfer roller in the course of cleaning transfer rollers.

Further, U.S. Pat. No. 5331383 and Japanese Patent O.P.I. Publication No. 119646/1993 disclose a technology wherein, in a transfer roller method, prescribed transfer voltage is impressed on a transfer roller and thereby an image is transferred onto a recording sheet, and when conducting a cleaning operation for moving toner sticking to the surface of the transfer roller to the surface of an image carrier, the transfer roller is impressed with voltage having polarity opposite to that in the course of transfer and then voltage having polarity identical to that of transfer voltage is impressed.

As described above, there have been known many means for transferring, through utilization of a transfer roller, an image formed on an image carrier onto a recording sheet.

It is especially necessary to improve transfer efficiency and cleaning efficiency of transfer rollers by switching polarity between a positive polarity and a negative polarity for voltage to be impressed on transfer rollers.

In an operation to transfer a toner image formed on an image carrier onto a recording sheet, when developing an electrostatic latent image formed on an image carrier by means of a developing unit, toner is caused to be opposite to the electrostatic latent image in terms of polarity for the stronger mutual attraction between the electrostatic latent image and the toner so that an excellent image may be formed. When transferring the toner image mentioned above onto a recording sheet, however, it is necessary to lower an adsorption force between the electrostatic latent image and the toner image, and this is achieved by a means such as of pre-transfer exposure or the like. Electric charges having polarity opposite to that of toner are impressed on the transfer roller and thereby the toner is attracted strongly toward a recording sheet so that the aforesaid toner image may be transferred fully onto the recording sheet. Therefore, toner for transfer tends, after being transferred onto the recording sheet, to stick to the transfer roller naturally, which requires efficient cleaning of the toner stuck. As is disclosed in the aforementioned prior art, therefore, cleaning is conducted by transferring the toner sticking to the transfer roller to an image carrier. Therefore, it is preferable to make an adsorption force between the transfer roller and the toner sticking thereto to be weak and to make an adsorption force between the image carrier and the toner to be strong, during a cleaning operation. Thus, an operation of each of the image carrier and the transfer roller in the course of transferring is quite contrary to that in the course of cleaning.

Full color toners with four colors which have become popular especially recently are used for forming color images on an image carrier. The color toners with four colors mentioned above are developed in the order of yellow (Y), magenta (M), cyan (C) and black (BK). When the color toners with four colors mentioned above are formed to be superposed on an image carrier, in particular, a difference of time after development between yellow (Y) toner developed first and black (BK) toner developed last is big, and an adsorption force varies between them accordingly, and the adsorption force also varies depending on the kinds of the four colors. Therefore, an adhesive force between toner and a transfer roller that is impressed with a certain positive bias voltage and a certain negative bias voltage varies, and thereby a part of the color toner sticks to the transfer roller strongly, making it impossible for toner sticking to the transfer roller to be transferred to an image carrier when the transfer roller is simply pressed against the image carrier. Thus, it is impossible to perform excellent cleaning. These conditions are the same even in the process for transferring images from a photoreceptor drum to a recording sheet through an intermediate transfer object.

SUMMARY OF THE INVENTION

The present invention has been achieved especially to eliminate the aforementioned disadvantages. Namely, an object of the invention is to form a color image by superposing color toners with multi-colors (4 colors) formed on an image carrier and especially to clean efficiently color toners still sticking to a transfer roller after transferring the color image from the above-mentioned image carrier to a recording sheet by means of the transfer roller, in an image forming apparatus.

The inventors of the invention found, after their experiments and studies, that when an average diameter of foams of a transfer roller composed of an elastic foam substance is smaller, it is more difficult for foreign substances sticking to the transfer roller to enter thereinto making cleaning of the transfer roller easier, and that toner, in particular, can be removed from a transfer roller when the transfer roller is pressed against an image carrier or an intermediate transfer object to be impressed alternately with positive bias voltage and negative bias voltage, and in this case again, when an average diameter of cells of a transfer roller is smaller, the transfer roller can be cleaned more easily.

The invention has been achieved based on the aforementioned knowledge and view.

An image forming method attaining the object mentioned above is represented by an image forming method comprising a process of passing a transfer material through the clearance between an image carrier having thereon toner images containing two or more colors superposed and a transfer means, a process of transferring the aforementioned toner images collectively and electrostatically onto the transfer material, and a process of cleaning thereafter the transfer means by pressing against the image carrier, wherein an average diameter of foams in the aforementioned transfer means is not less than 1 μm and not more than 300 μm, and positive bias voltage and negative bias voltage are impressed alternately on the transfer means in the course of cleaning.

An image forming apparatus of the invention is represented by an image forming apparatus comprising an image carrier capable of forming an electrostatic latent image, a developing unit performing superposing development with charged toners of two or more colors on the image carrier, and a transfer means that transfers a toner image obtained through the aforementioned development onto a transfer material collectively and electrostatically, wherein an average diameter of cells in the transfer means is not less than 1 μm and not more than 300 μm.

The transfer means mentioned above is provided with a means for impressing positive bias voltage and negative bias voltage alternately.

The transfer means mentioned above is provided with a means that impresses bias voltage whose polarity for transferring is different from that for cleaning.

Further, the aforesaid object is attained in an image forming apparatus capable of transferring an image formed on an image carrier onto a transfer material that passes through the image carrier and a transfer means both are kept to be in pressure contact each other, when the transfer means impresses bias voltage having polarity opposite to that of the toner mentioned above in the course of transferring, and the transfer means is formed by an elastic foam substance whose average cell diameter is 1–300 μm, and bias voltage with polarity opposite to and identical to that in the course of transferring are impressed by switching them 6 times or more during a certain non-transferring period of the transfer means.

The image forming apparatus mentioned above is a color image forming apparatus wherein toner images with two or more colors are formed on an image carrier.

The transfer means mentioned above is brought into pressure contact with the image carrier by a force of 100–700 g/cm$^2$ in the course of non-transferring.

The image forming apparatus mentioned above is provided with a cleaning blade coming in contact with an image carrier, having elasticity and having hardness of 40°–90° (hardness stipulated by JIS K630 Stipulation A).

The transfer means mentioned above is a transfer roller.

Bias voltage with polarity opposite to and identical to that of toner are impressed under the following conditions during a certain non-transferring period of the transfer means.

0.3<bias voltage with the same polarity of toner/bias voltage with opposite polarity to that of toner≦1.

Bias voltage with polarity opposite to and identical to that of toner are impressed under the following conditions during a certain non-transferring period of the transfer means.

Time required for transfer roller to make 0.5 turns≦time required by bias voltage with polarity opposite to or identical to that of toner≦time required for transfer roller to make 1.5 turns It is preferable that an average diameter of cells in the transfer means is 20–200 μm.

It is preferable that the transfer means is brought into contact with the image carrier by a pressing force of 200–600 g/cm$^2$.

It is preferable that bias voltage with polarity opposite to and identical to that of toner are impressed under the following conditions during a certain non-transferring period of the transfer means.

0.5<bias voltage with polarity identical to that of toner/bias voltage with polarity opposite to that of toner≦1

It is preferable that bias voltage with polarity opposite to and identical to that of toner are impressed under the following conditions during a certain non-transferring period of the transfer means.

Time required for transfer roller to make 0.7 turns≦time required by bias voltage with polarity opposite to or identical to that of toner to be impressed once≦time required for transfer roller to make 1.3 turns It is preferable that bias voltage with polarity opposite to and identical to that of toner are impressed by switching them 6–20 times, during a certain non-transferring period of the transfer means.

An absolute values of bias voltage having polarity opposite to and identical to that of toner are 0.5 KV–3.5 KV, during a certain non-transferring period of the transfer means.

During a certain non-transferring period of the transfer means, polarity of constant voltage identical to the polarity of toner and polarity of constant current opposite to the polarity of toner are impressed alternately.

A radius of curvature for the image carrier mentioned above positioned at least at a transfer position or a separation position against a recording sheet is 40 mm or more.

Further, the object mentioned above is attained in an image forming apparatus capable of transferring an image formed on an image carrier onto a transfer material that passes through the image carrier and a transfer means both are kept to be in pressure contact each other, when the transfer roller impresses bias voltage having polarity opposite to that of the toner mentioned above in the course of transferring, and the transfer roller is formed by an elastic foam substance whose average cell diameter is 1–300 μm, and bias voltage with polarity opposite to and identical to that of toner are impressed by switching the 6–20 times during a certain non-transferring period of the transfer roller with the transfer roller brought into pressure contact with the image carrier by a pressing force of 100–700 g/cm$^2$ in the course of non-transferring..

The transfer roller mentioned above comes in close contact with the image carrier and leaves it.

The object mentioned above is attained by a color image forming apparatus having therein an image forming means for forming a toner image composed of two or more different color toner images superposed on an image carrier, and being capable of passing a recording sheet through the image carrier having thereon the aforementioned toner image and a transfer means while keeping them in pressure contact and thereby of transferring the toner image on the image carrier onto the recording sheet electrostatically and collectively, wherein the transfer means is brought into pressure contact with the image carrier and bias voltage opposite to and identical to that in the course of a transfer operation, in other words, an electric bias having an identical polarity of toner and an electric bias having an opposite polarity to that of toner are impressed on the transfer means for at least a certain non-transferring period, and a pressing force of the transfer means against the image carrier is 100–700 g/cm$^2$. A preferable example in the aforementioned constitution will be shown below. The transfer means mentioned above is a pressure transfer roller. The pressure transfer roller is made of a foam resin material. The image carrier mentioned above is a photoreceptor drum or a photoreceptor belt. The aforementioned developing unit is a two-component developing means wherein D.C. component and A.C. component are superposed on the surface of the image carrier and at a developing area of the developing means holding therein two-component developing agents. The developing means is a non-contact developing means. The developing means is a reversal developing means. The image carrier is non-contact developing means. A radius of curvature for the image carrier mentioned above positioned at least at a transfer position or a separation position against a recording sheet is 40 mm or more.

DETAILED DESCRIPTION OF THE PREFERRED EMBODIMENT

Prior to explanation of an example of the invention, the constitution of a color printer representing an example of an image forming apparatus of the invention and its operation will be explained first, referring to FIG. 1.

The printer mentioned above is a color image forming apparatus wherein toner images each being different from others in terms of color are formed in succession on an image carrier and superposed, then, they are transferred, at a transfer section, collectively to be a color image on a recording sheet which is then separated from the image carrier surface by a separating means.

Figure 1:
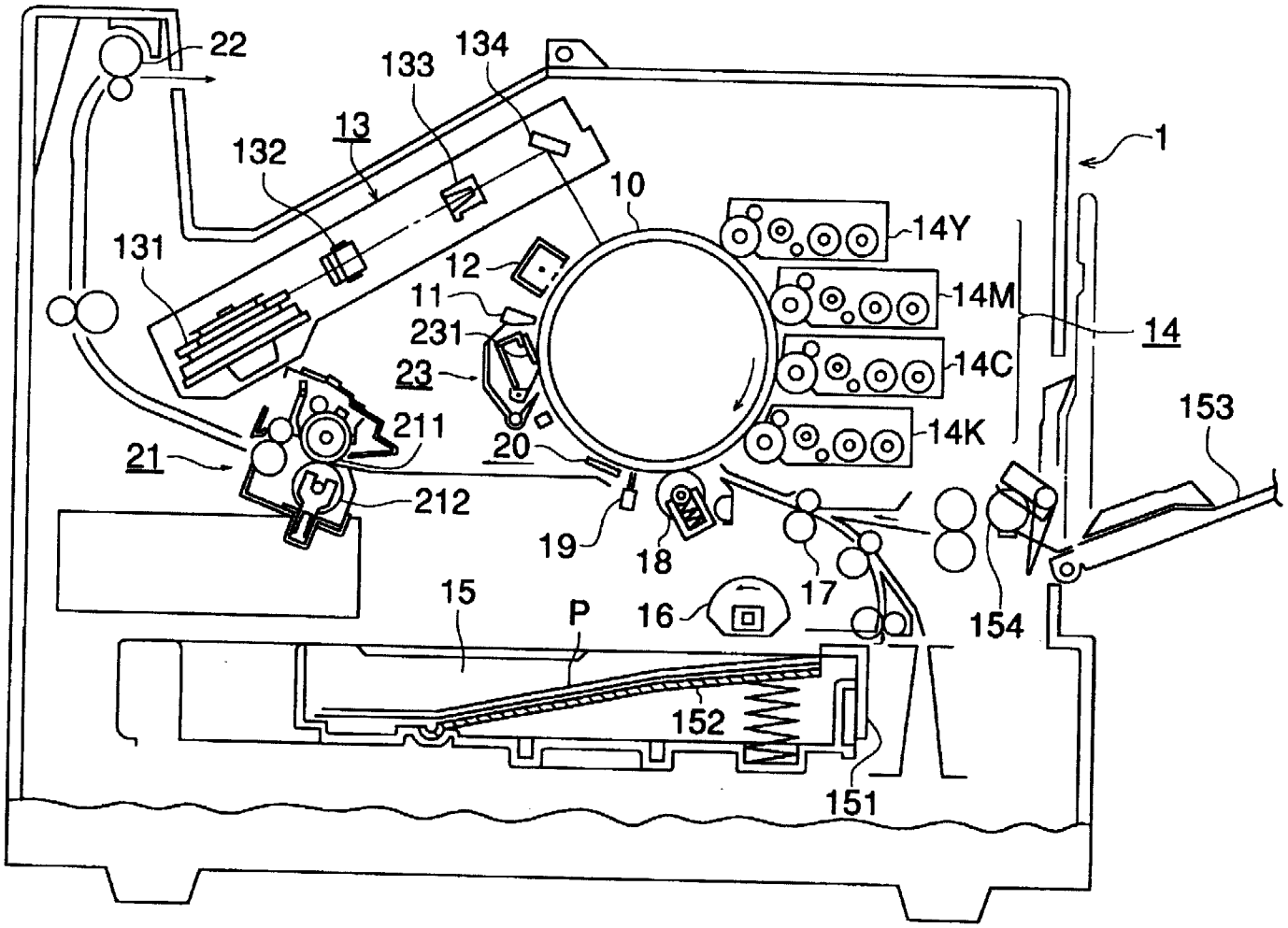
FIG. 1 is a sectional view of a color printer that is an example of an image forming apparatus of the invention.

In FIG. 1, the numeral 10 represents an image carrier which is a photoreceptor drum or a photoreceptor belt. Materials such as Se, $As_2$, $Se_3$, a-Si and OPC are used as a photoreceptor drum, in this case. As the OPC to be used in this case, those employing Y-type titanyl phthalocyanin or polycrystal titanyl phthalocyanin described in Japanese Patent O.P.I. Publication Nos. 17066/1989, 183258/1990, 183265/1990 and 128973/1991 are preferable. The OPC photoreceptor (organic photoreceptor) coated on a drum base body is grounded and driven to rotate clockwise in the figure. The numeral 12 is a scorotron charger and uniform charging with $V_H$ is given to the surface of photoreceptor drum 10 through corona discharge by means of a grid kept at voltage of $V_G$ and a corona discharge wire. Prior to this charging by means of the scorotron charger 12, a circumferential surface of a photoreceptor is neutralized through exposure by means of PCL (pre-charging lamp) 11 wherein a light-emitting diode is used, so that hysteresis extending to the preceding print on the photoreceptor may be eliminated.

After the photoreceptor drum 10 is charged uniformly, it is subjected to imagewise exposure based on image signals conducted by imagewise exposure means 13. The imagewise exposure means 13 is equipped with an unillustrated laser diode which serves as a light source, and a laser beam from it passes through rotating polygon mirror 131, fθ lens 132, cylindrical lens 133 and reflection mirror 134 where an optical path of the laser beam is deflected for main scanning which forms, together with a rotation (sub-scanning) of the photoreceptor drum 10, a latent image. In the present example, exposure is made for a character area to form a reversal latent image wherein the character area is under low voltage $V_L$.

Around the photoreceptor drum 10, there are provided developing units 14 (14Y, 14M, 14C and 14K) each containing developer composed of carrier and each of toners of yellow (Y), magenta (M), cyan (C) and black (K). First, development for the first color of yellow is conducted by developing sleeve 141 which houses magnets and rotates while holding therein the developer. The developer is two-component developer composed of a carrier particle whose core is ferrite that is coated with insulating resins and a toner particle whose primary material is polyester to which a dye corresponding to the color, charge control agent, silica and titanium oxide are added, and the developer is transported to the developing area after being regulated to be a layer thickness (developer) of 100–600 μm on the developing sleeve 141 by a layer forming means.

A clearance between the developing sleeve 141 and the photoreceptor drum 10 at the developing area is made to be 0.2–1.0 mm which is greater than the layer thickness (developer), and AC bias of $V_{AC}$ and DC bias of $V_{DC}$ are superposed to be impressed on that clearance. Since $V_{DC}$, electrostatic voltage $V_H$ and toner charging are the same in polarity, toner that is given a clue to leave a carrier by $V_{AC}$ does not stick to the area of $V_H$ that is higher than $V_{DC}$ but sticks to the area of $V_L$ lower than $V_{DC}$, for visualization (reversal development).

After completion of visualization for the first color, there is started an image forming process for magenta which is the second color wherein scorotron charger 12 charges uniformly again, and a latent image based on image data of the second color is formed by imagewise exposure means 13. In this case, neutralizing by means of PCL 11 performed in the image forming process for the first color is not conducted because of the fear that toner adhering to the image area for the first color may scatter due to rapid drop of surrounding voltage.

Among the entire circumferential surface of the photoreceptor drum 10 where voltage arrives at $V_H$ again, the area where no image for the first color exists is subjected to forming and developing of a latent image similar to that for the first color, while on the area that has an image for the first color and is to be developed again, a latent image of $V_M'$ is formed by light-shielding by sticking first toner and by electric charges owned by the toner itself, to be subjected to developed based on voltage difference between $V_{DC}$ and $V_M'$. On the area where an image for the second color is superposed on that for the first color, when development for the first color is conducted after forming a latent image of $V_L$, a balance between the first color and the second color is lost. Therefore, intermediate voltage satisfying $V_H>V_M>V_L$ is sometimes taken by reducing an amount of exposure for the first color.

For the third color of cyan and the fourth color of black too, image forming processes identical to that for the second color are conducted, thus, four visual images each differing in color from others are formed on the circumferential surface of the photoreceptor drum 10.

On the other hand, recording sheets P lifted by lifting plate 152 in sheet-feed cassette 15 are taken out through half-moon roller 16, and separated by separation claw 151 to be single recording sheet P to be conveyed. Then, the recording sheet P is stopped by sheet-feeding roller 17 temporarily until the transfer timing is arranged, and is fed to the transfer area by the rotating sheet-feeding roller 17.

In the transfer area, transfer roller 18 is brought into pressure contact with the circumferential surface of the photoreceptor drum 10 in synchronization with transfer timing, thus, fed recording sheet P is sandwiched so that a multi-color image may be transferred collectively.

Then, the recording sheet P is neutralized by separation brush 19 which is brought into pressure contact almost simultaneously, and then is separated from the circumferential surface of the photoreceptor drum 10 by the separation means 19 which separates recording sheet P by neutralizing it with separation power source 190. Incidentally, the radius of curvature of the photoreceptor drum 10 at a position of each of the aforementioned transfer and separation is set to 40 mm or more. Then, the recording sheet P is transported, after being separated, to fixing unit 20 where heating and pressing by means of heat roller (upper roller) 211 and pressure roller (lower roller) 212 fuse and fix toner on the recording sheet P which is ejected out of an apparatus through ejection roller 22. Incidentally, the above-mentioned transfer roller 18 and separation roller 19 leave the circumferential surface of the photoreceptor drum 10 after the recording sheet P passes through them to be ready for the succeeding formation of toner images.

The photoreceptor drum 10 from which the recording sheet P has been separated, on the other hand, is cleaned to be free from remaining toner by blade 231 of cleaning unit 23 through its pressure contact, and is subjected to neutralizing by means of PCL 11 and to charging by means of charging unit 12 to enter the succeeding process of image information. Incidentally, the above-mentioned blade moves to leave the circumferential surface of the photoreceptor drum 10 immediately after the photoreceptor surface is cleaned.

The blade 231 has a Young's modulus of 2–2000 kg/cm$^2$ and preferably of 50–100 kg/cm$^2$, and it is preferable that its hardness is 40°–90° (hardness stipulated by JIS K630 Stipulation A). When the blade 231 having the hardness within the aforesaid range is used, it is possible to remove toner remaining on an image carrier more efficiently. The blade may be brought into contact either through a counter method or through a trail method.

The numeral 153 is a sheet feeding unit through which recording sheet P is fed manually, and it is fed out by sheet feeding roller 154 to be transported in a form of a single recording sheet P and is stopped temporarily by the second sheet feeding roller 17, then, it is fed to a transfer area by a rotation of the sheet feeding roller 17 when timing for transfer has been adjusted.

Figure 2:
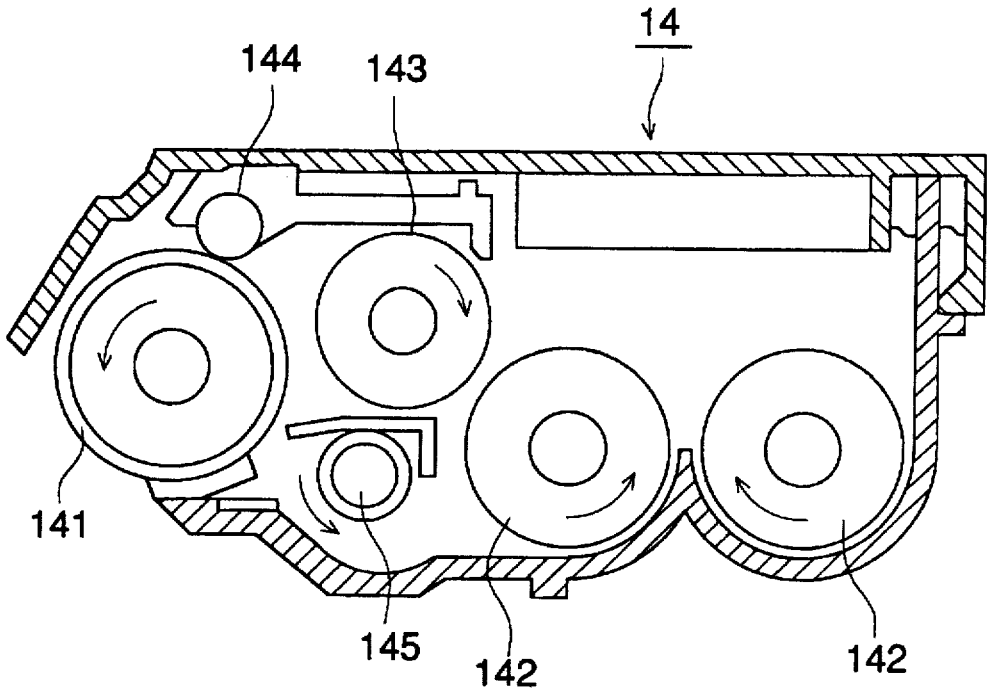
FIG. 2 is a sectional view of a developing unit.

FIG. 2 is a sectional view showing how developing unit 14 is structured, wherein toner supplied from a toner supply box is dropped at a right end portion of the developing unit 14 and is stirred and mixed with a carrier to be set to a predetermined amount of charging (Q/M) by paired stirring screws 142 which rotate in reverse directions each other.

On the other hand, toner density is detected by a magnetic permeability detection method (L detection method), and an amount of toner to be supplied is controlled in accordance with a frequency based on the detection so that a toner density value may be set and controlled at about 5–7%.

A two-component developer thus stirred is conveyed to developing sleeve 141 through supply roller 143 and then is conveyed to a developing area on the photoreceptor drum 10 after being made to be a thin layer by layer thickness regulating member 144 so that reversal development of an electrostatic latent image is conducted under the developing conditions described later. In this developing method, a brush of developer is not in contact with photoreceptor drum 10 when development is performed, and non-contact two-component reversal development is conducted in the electric field where A.C. component is superposed on D.C. component.

Development distance: 0.5 mm

Amount of toner conveyed: 20–30 mg/cm$^2$

Developing bias (AC): 2 KV, 8 KHZ (DC): −750 V

Rotating direction of developing sleeve: Direction opposite to that of a photoreceptor drum (Moving directions of points on the developing sleeve and the photoreceptor drum closest to each other are the same)

Image density adjustment: L detection method

Next, pressure transfer roller 18 will be explained as follows.

A position of the pressure transfer roller 18 on the circumferential surface of photoreceptor drum 10 is variable, and when printing a monochromatic image, the pressure transfer roller 18 is positioned to be in pressure contact with the photoreceptor drum 10, while, when forming a color image, it is kept to be away from the photoreceptor drum 10 and it is brought into contact only when transferring is conducted. After transferring the color image onto recording sheet P, the pressure transfer roller 18 is brought into pressure contact with the circumferential surface of the photoreceptor drum 10 for cleaning.

Figure 3:
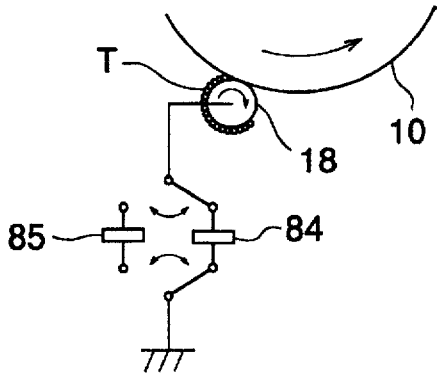
FIGS. 3 (*a*)–3 (*c*) represent an illustration showing how to clean on an image forming apparatus of the invention.
Figure 3:
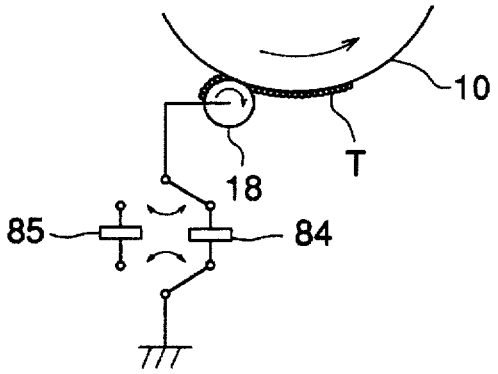
Figure 3:
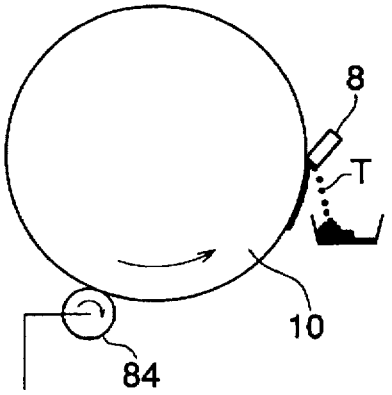

FIGS. 3 (*a*)–3 (*c*) represent how to clean, and when transfer roller 18 on which toner T is sticking is brought into pressure contact with photoreceptor drum 10 while switching bias power source for the transfer roller 18 from that for transfer 85 to that for cleaning 84 after transfer sheet P has passed as shown in FIG. 3 (*a*), the toner T sticking on the transfer roller 5 moves onto the photoreceptor drum 10 as shown in FIG. 3 (*b*), and then the toner T on the photoreceptor drum 10 is removed by cleaning blade 8 as shown in FIG. 3 (*c*).

When considering how toner T sticking to transfer roller 18 can be cleaned efficiently, it is preferable to make an average cell diameter of the transfer roller to be not less than 1 μm and not more than 300 μm, for example, in the invention as stated above.

In this case, an average cell diameter of the transfer roller is defined as follows.

(1) When the transfer roller is of an individual foam

Figure 4:
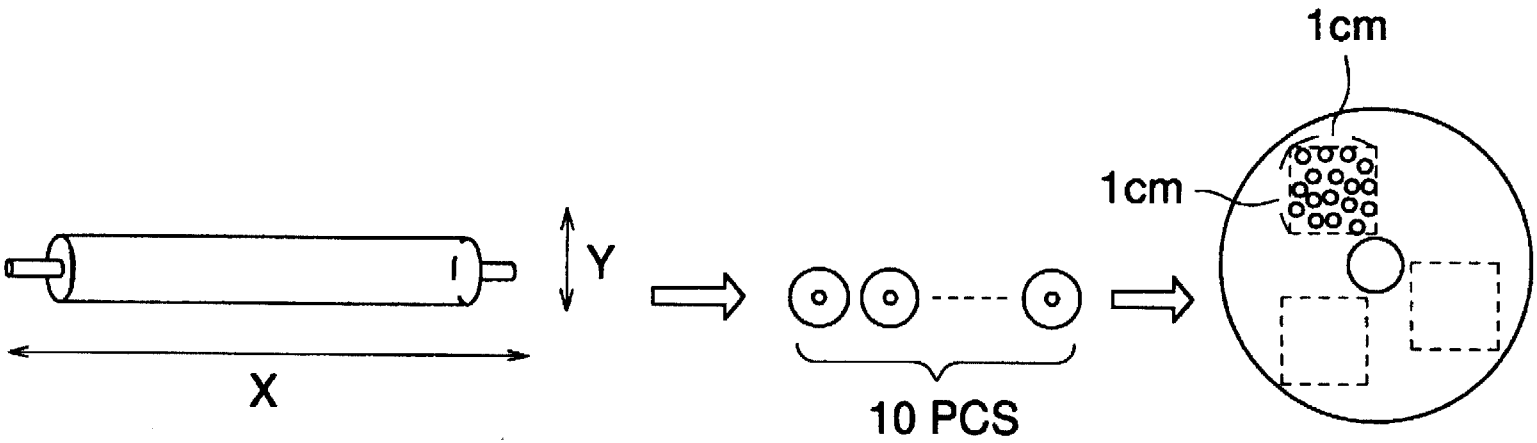
FIG. 4 is an illustration showing how to measure an average foam diameter of a transfer roller.

In FIG. 4, the transfer roller is cut into arbitrary ten pieces in the Y direction, and arbitrary three points of each of them are magnified under a microscope so that cell diameters are obtained through the following expression, and an average value of 10 pieces×3 points=30 data is obtained.

Figure 5:
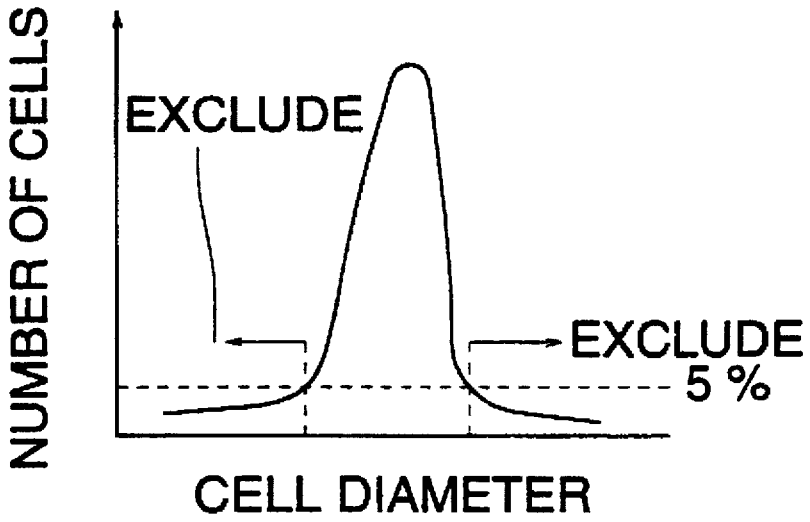
FIG. 5 is an illustration showing how to measure an average cell diameter of a transfer roller.

(the total of cell diameters existing in 1 $cm^3$)/(the total number of cells existing in 1 $cm^3$) [provided that cell diameters for the number of cells represent not more than 5% of the total number of cells in a cell diameter distribution in FIG. 5 are excluded for calculation]

(2) When the transfer roller is of a chained cell

Measurement is conducted in the same manner as in (1). in case of the chained foam, however, the cell is not a complete round but is like a hole. A diameter in this case is defined to be an average value of the maximum radius and the minimum radius of the cell.

A scratch and a hole made artificially are not regarded as a cell.

Table 1 shows relations between the following transfer rollers A–E and paper dust, dust, toner and other foreign material contained in 1 $cm^3$ including the roller surface after making 5000 copies.

TABLE 1

| Types of transfer rollers | Paper dust (pcs./$cm^3$) | Dust (pcs./$cm^3$) | Toner (pcs./$cm^3$) | Other foreign materials (pcs./$cm^3$) |
|---|---|---|---|---|
| A | 12 | 5 | 153 | 22 |
| B | 7 | 4 | 43 | 8 |
| C | 0 | 0 | 7 | 2 |
| D | 50 | 11 | 1523 | 88 |
| E | 87 | 29 | 3842 | 152 |

Transfer roller A is of an individual cell type of an ion conductive type made by Bridgestone Corp.,with hardness 33 (ASUKA-C hardness tester), electric resistance $3\times10^7$ Ω and an average cell diameter of 200 μm.

Transfer roller B is of an individual cell type of an ion conductive type made by Sumitomo Rubber Corp.,with hardness 36 (ASUKA-C hardness tester), electric resistance of $7.5\times10^7$ Ω and an average cell diameter of 80 μm.

Transfer roller C is of a chained cell type of carbon black-containing RUBICEL (polyurethane foam type) made by Nitto Kogyo Corp., with hardness 30 (ASUKA-C hardness tester), electric resistance of $2\times10^8$ Ω and an average cell diameter of 20 μm.

Transfer roller D is of an individual cell type with an average cell diameter of 350 μm and electric resistance of $3\times10^7$ Ω. Transfer roller E is of an individual cell type with an average cell diameter of 500 μm and electric resistance of $5\times10^7$ Ω.

The Table 1 mentioned above indicates that the greater an average cell diameter in a transfer roller becomes, the more easily the paper dust, dust, toner and foreign materials such as dust can enter the cell.

Figure 6:
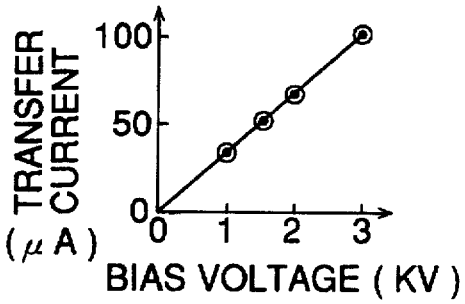
FIGS. 6 (*a*)–6 (*e*) represent diagrams for illustrating characteristics of an image forming apparatus of the invention.
Figure 6:
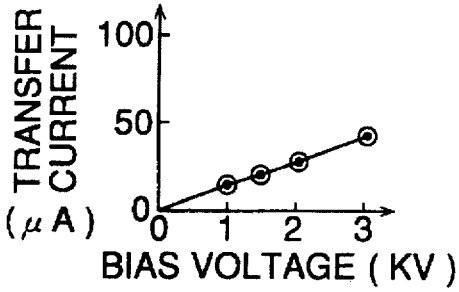
Figure 6:
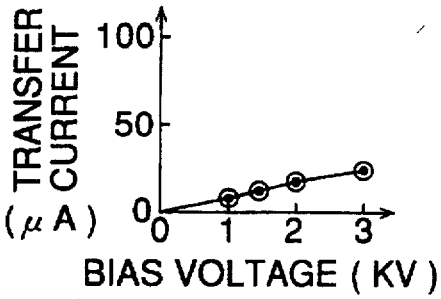
Figure 6:
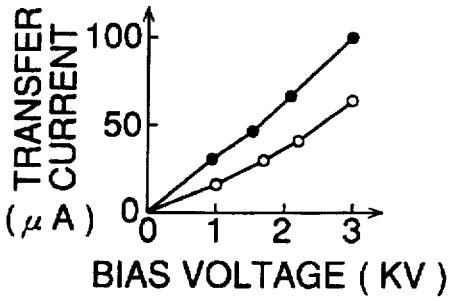
Figure 6:
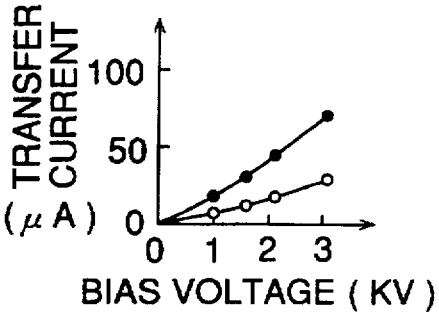

FIGS. 6 (*a*)–6 (*e*) represent a correlation between a bias voltage to be impressed on a transfer roller and transfer current at two occasions, one is a moment to start copying (shown with ".") and the other is a moment after making 5000 copies (shown with "O"), respectively for transfer rollers A–E. Conditions under which the correlations mentioned above were obtained include that each of the transfer rollers A–E was prepared to have a diameter of 16 mm, a length of 310 mm and a wall thickness of 4 mm, and it was pressed against a 30 mm diameter aluminum pipe with a pressure of 170 g/$cm^2$ to be measured under the conditions of a temperature of 20° C. and a humidity of 50%.

These figures mentioned above indicate that when an average cell diameter in a transfer roller is greater, foreign materials tend to enter a cell, resulting in a change in electric resistance of the transfer roller.

Table 2 indicates that a solid image having toner with negative polarity of 1.2 mg/$cm^2$ is formed on a photoreceptor drum under ambient conditions of a temperature of 20° C. and a humidity of 50%, then the image is transferred onto an 16 mm diameter transfer roller directly, and the toner sticking to the transfer roller is returned again to the photoreceptor drum by applying positive bias voltage and negative bias voltage alternately on the photoreceptor drum so that achievement rate of cleaning in that occasion may be obtained.

TABLE 2

| Types of transfer rollers | Negative bias voltage (KV) | Positive bias voltage (KV) | Achievement rate for cleaning (%) |
|---|---|---|---|
| A | −3 | +3 | 92 |
| B | −2.5 | +2.5 | 95 |
| C | −3.5 | +3 | 98 |
| D | −3 | +3 | 74 |
| E | −3.5 | +3.5 | 62 |

Figure 7:
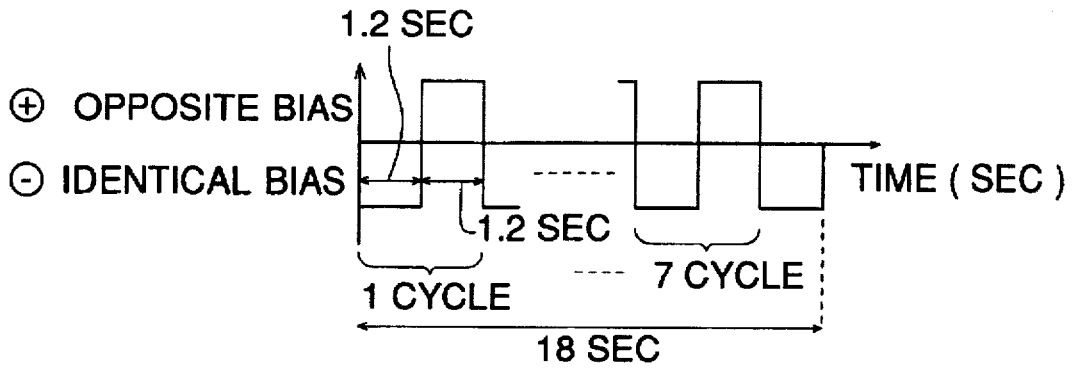
FIG. 7 is a diagram for illustration for an image forming apparatus of the invention.

FIG. 7 shows a timing chart for impressing the positive bias voltage and negative bias voltage mentioned above. Incidentally, the achievement rate of cleaning in this case is a ratio of (weight of toner sticking to transfer roller before cleaning—weight of toner remaining on transfer roller surface after cleaning)/(weight of toner sticking to transfer roller before cleaning) that is shown in terms of percentage.

The bias voltage to be impressed mentioned above is to be changed variously depending on types and diameters of transfer rollers as well as on polarity of toner and environmental conditions.

Preferable timing for cleaning the transfer roller includes (1) a moment of power ON, (2) a moment immediately after occurrence of jam, and (3) a moment after completion of printing.

Table 3 shows an example of a preferable transfer roller having an average cell diameter (1 μm–300 μm).

TABLE 3

| Company name | Type | Hardness (Asuka C Hardness tester) | Electric resistance (Ω) | Average cell diameter (μm) | Form type | Achievement rate for cleaning (%) |
|---|---|---|---|---|---|---|
| Bridgestone Corp. | Urethane ion conductive type | 33 | $3 \times 10^7$ | 200 | Individual foam | 92 |
| Bridgestone Corp. | Urethane electron conductive type | 36 | $2.5 \times 10^7$ | 70 | Individual foam | 96 |
| Sumitomo Rubber Industry Corp. | Ion conductive type | 36 | $7.5 \times 10^7$ | 80 | Individual foam | 95 |
| Nitto Kogyo Corp. (Toyo Polymer Corp.) | Carbon-black-containing rubisel type (Polyurethane foam type) | 30 | $2 \times 10^8$ | 20 | Chained foam | 98 |
| Inoac Corp. | Urethane ion conductive type (ENDUR) | 32 | $8 \times 10^7$ | 100 | Individual foam | 94 |
| Hokushin Kogyo Corp. | Urethane foam type | 52 | $1 \times 10^8$ | 100 | Individual foam | 93 |
| Shin-etsu Polymer Corp. | Silicone foam type | 40 | $2 \times 10^8$ | 110 | Individual foam | 92 |

Incidentally, a transfer roller is generally caused to have a proper degree of elasticity by adding a plasticizer to rubber and further to have conductivity by adding conductive materials. When the plasticizer is increased, a transfer roller is made to be softer, but its foam diameter is forced to be made larger. When the plasticizer is decreased to make the foam diameter small, on the contrary, the transfer roller is forced to be hard. When transferring with a transfer roller, the transfer roller needs to be soft to a certain extent for preventing scratches on a photoreceptor drum and for securing a roller nip because the transfer roller is pressed against the photoreceptor drum for transferring. When an average foam diameter is less than 1 μm, it is impossible to give sufficient elasticity to the transfer roller. Therefore, the average cell diameter of not less than 1 μm is preferable and that of 20–200 μm is more preferable.

Incidentally, when transfer rollers made by various companies (differing in materials and component composition each other) are prepared to be 16 mm in diameter, 310 mm in length and 4 mm in wall thickness and each of them is pressed against a 30 mm diameter aluminum base pipe by pressure of 170 g/cm$^2$, the electric resistance value of the transfer roller mentioned above is one obtained by measuring between a rotating shaft of the transfer roller and the aluminum base pipe under the ambient conditions of a temperature of 20° C. and a humidity of 50%.

Comparative test regarding a transfer roller in the invention will be explained as follows. Pressure transfer roller in FIG. 8 was composed of shaft body (core metal) 181 consisting of a stainless steel bar and roller portion 182 made of foam silicone resin, or foam polyurethane resin or EPDM resin (all made by Bridgestone Corp.). It was structured with roller portion 182 shown below.

Roller portion 182, diameter: 16 mm

Shaft body (core metal) 181, diameter: 8 mm

Hardness: 30° (JIS-K6301 Asuka C scale hardness)

Resistance value: $3.0 \times 10^7$ Ω (measured at 20° C., 50%)

Pressure of pressure transfer roller 18: 230 g/cm$^2$

Measurement of pressure: Measured by nip tester (using a nip width sensor made by Toshiba Silicone Corp.)

For bias voltage for cleaning the pressure transfer roller 18, two type of bias voltage impressing means such as positive/negative bias voltage impressing means 184 that impresses positive bias voltage and negative bias voltage and negative bias voltage impressing means 185 that impresses negative bias voltage only were prepared, and there was provided change over switch 186 to switch them.

Figure 9:
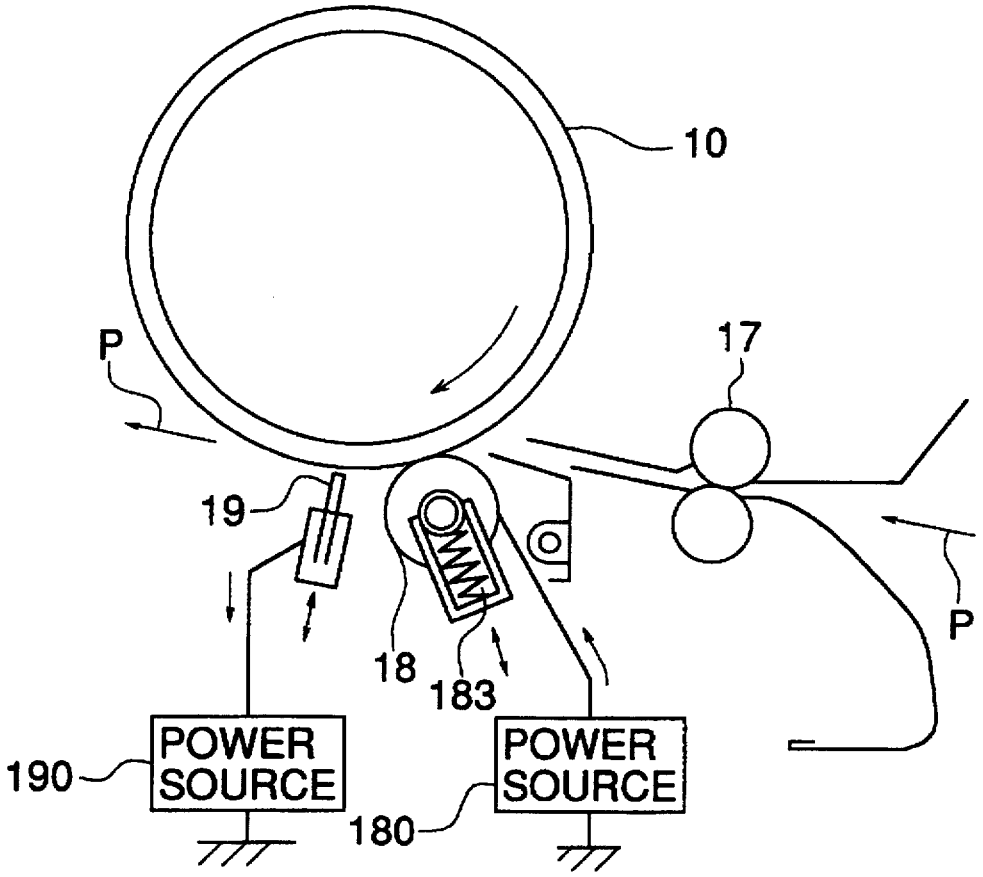
FIG. 9 is a schematic diagram showing a pressure transfer roller of the invention and a photoreceptor drum.

Referring to FIG. 9, the steps to feed recording sheet P and to transfer and separate a color image in image forming apparatus 1 structured as in the foregoing were conducted as follows.

As shown in FIG. 9, recording sheet P fed out from sheet-feed cassette 15 through half-moon roller 16 was stopped temporarily, and was fed to the transfer area through rotation of sheet-feed roller 17 when timing for transferring has been arranged.

Pressure transfer roller 18 was structured so that it could contact and leave photoreceptor drum 10 and further could come in contact with the photoreceptor drum 10 through elastic member 183. It was structured in a way that it was in contact as shown in FIG. 9 when transferring a monochromatic image onto recording sheet P, while when a color image was formed by photoreceptor drum 10, it left and was kept at a position being away from the photoreceptor drum 10 surface, and was brought into pressure contact only for transferring. As a means for bringing the pressure transfer roller 18 into pressure contact with and for retracting it from the photoreceptor drum surface, a cam mechanism, a combination of a cam and a lever, or a motor could be used. On the occasion of the transferring mentioned above, current of +12 μA was given to the pressure transfer roller 18 by a constant current power source in power supply 180 for transfer.

Figure 8:
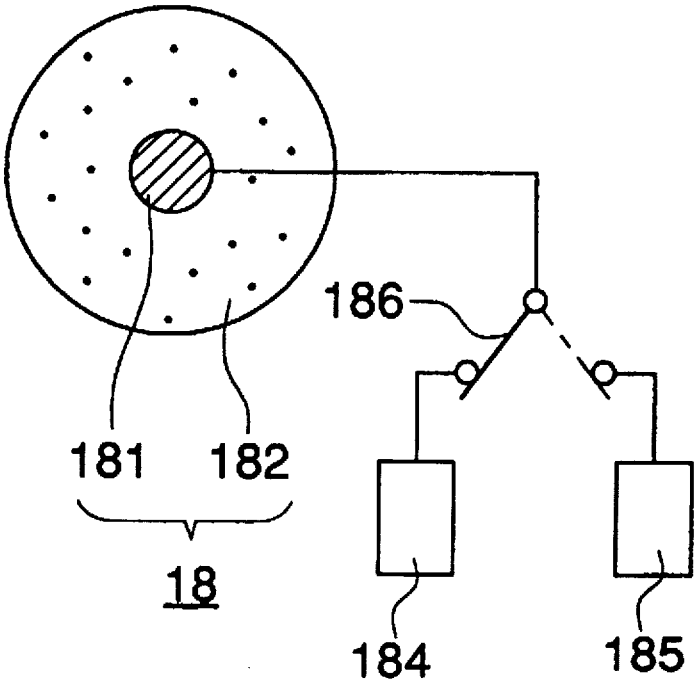
FIG. 8 is a schematic diagram showing a pressure transfer roller of the invention and how to switch transfer voltage.
Figure 10:
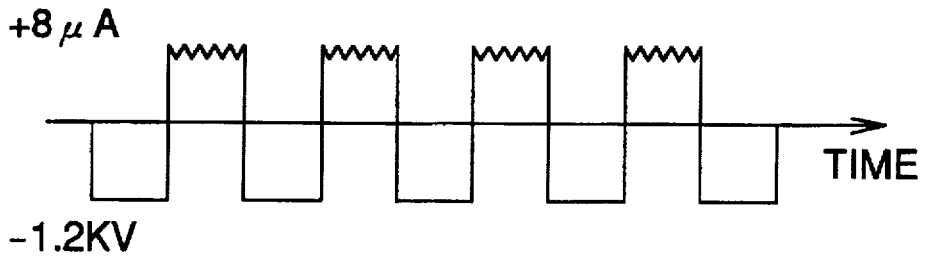
FIGS. 10 (*a*) and 10 (*b*) are illustrations showing positive transfer voltage and negative transfer voltage in the invention.
Figure 10:
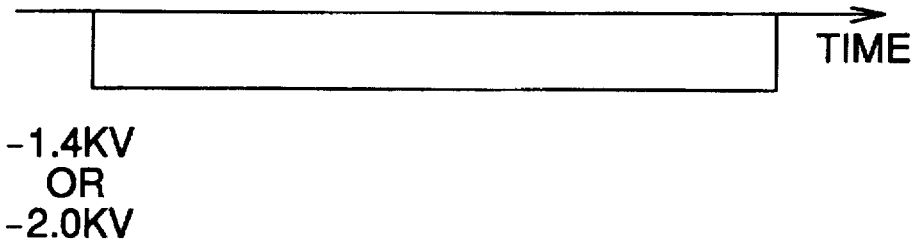

When power supply 180 was switched to positive/negative bias voltage impressing means 184 by change-over switch 186 in the case of cleaning as shown in FIG. 8, constant current of 8 μA as positive bias (+) was impressed on pressure transfer roller 18 and constant voltage of 1.2 KV as negative bias (−) as shown in FIG. 10 was impressed on it.

When change-over switch 186 was switched to negative bias voltage impressing means 185 in the case of cleaning as shown in FIG. 8, constant voltage of (−)1.4 KV or 2.0 KV was impressed as shown in FIG. 10 (*b*).

Next, the pressure for the pressure transfer roller 18 will be explained.

When transferring a color image formed on the photoreceptor drum 10 onto recording sheet P, transfer voltage is applied for transferring the color image onto the recording sheet P. However, it is possible to transfer efficiently by pressing the pressure transfer roller 18 against the photoreceptor drum 10 through recording sheet P with pressure of 230 g/cm$^2$ as stated above. When roller portion 182 of the pressure transfer roller 18 is brought into contact with and pressed against the surface of the photoreceptor drum 10 with the pressure of 230 g/cm$^2$, color toner sticking to the outer surface of the roller portion 182 can be transferred to the photoreceptor drum 10 surface and the outer circumferential surface of the roller portion 182 can be cleaned.

Table 4 shown below shows the pressure with which the roller portion 182 of the pressure transfer roller 18 is pressed against the photoreceptor drum 10 surface and the cleaning efficiency corresponding thereto.

TABLE 4

| | Pressure of pressure transfer roller g/cm$^2$ | Method of impressing bias voltage | Efficiency of cleaning pressure transfer roller: Initial | Efficiency of cleaning pressure transfer roller: After making 80 copies |
|---|---|---|---|---|
| Example 1 | 200 | Positive and negative | >95% | >95% |
| Example 2 | 300 | Positive and negative | >95% | >95% |
| Example 3 | 400 | Positive and negative | >95% | >95% |
| Example 4 | 600 | Positive and negative | >95% | >95% |
| Example 5 | 300 (roller hardness 40) | Positive and negative | >95% | >95% |
| Comparative example 1 | 1000 | Positive and negative | >95% | 60% |
| Comparative example 2 | 50 | Positive and negative | 70% | 40% |
| Comparative example 3 | 400 | Negative only | 80% (−1.4 kv) | 65% |
| Comparative example 4 | 500 | Negative only | 80% (−2.0 kv) | 70% |

As shown in Table 4, when cleaning was conducted between pressure transfer roller 18 and the photoreceptor drum 10 using pressures of 200 g/cm$^2$, 300 g/cm$^2$, 400 g/cm$^2$ and 600 g/cm$^2$ respectively for Examples 1, 2, 3 and 4 in alternate impression of positive and negative biases, cleaning in efficiency of 95% or more was achieved for the initial stage as well as for the stage when 80 copies were completed. In Example 5, where roller portion 182 with hardness of 40 was used and the pressure of the pressure transfer roller was 300 g/cm$^2$, cleaning in efficiency of 95% or more was also achieved for the initial stage as well as for the stage when 80 copies were completed.

Next, as shown in Table 4, when cleaning was conducted between pressure transfer roller 18 and the photoreceptor drum 10 using pressures of 1000 g/cm$^2$ and 50 g/cm$^2$ respectively for Comparative examples 1 and 2 in alternate impression of positive and negative biases, cleaning efficiency for pressure of 1000 g/cm$^2$ for the initial stage was 95% or more, but that for the stage when 80 copies were finished was lowered to 65%. For the pressure of 50 g/cm$^2$, cleaning efficiency for the initial stage was 70%, but that for the stage when 80 copies were finished was lowered to 40%, which means a reduction by half of cleaning efficiency. Next, when cleaning was conducted between pressure transfer roller 18 and the photoreceptor drum 10 using pressures of 400 g/cm$^2$ and 500 g/cm$^2$ respectively for Comparative examples 3 and 4 in impression of negative biases only, cleaning with efficiency of 80% was conducted for the initial stage and that with efficiency of 65% was conducted for the stage when 80 copies were finished when the pressure was 400 g/cm$^2$ and negative bias was impressed at −1.4 KV. When the pressure was 500 g/cm$^2$ and negative bias was impressed at −2.0 KV, on the other hand, cleaning with efficiency of 80% was conducted for the initial stage and that with efficiency of 70% was conducted for the stage when 80 copies were finished.

In the invention, as described above, cleaning efficiency of 95% can be achieved between pressure transfer roller 18 and photoreceptor drum 10 when the pressure with which the pressure transfer roller 18 is pressed against the photoreceptor drum 10 is made to be 200–600 g/cm$^2$ and positive and negative biases are impressed alternately as stated above.

With regard the transfer bias voltage mentioned above, the inventors of the invention made various tests and obtained the following results.

1) Bias voltage level (absolute value)

In the invention, it is preferable, from the viewpoint of image quality and image stability, that bias voltage whose polarity is opposite to and identical to the polarity of toner is set in a range of 0.5–3.5 KV in terms of absolute value during a certain period of non-transfer time of the transfer means. When it is less than 0.5 KV, an effect of impressing voltage hardly appears, while, when it exceeds 3.5 KV, aerial discharge takes place between the transfer means and a photoreceptor, and damage tends to be caused and a large power supply is required, resulting in cost increase.

2) Ratio of bias voltage level in alternate voltage-impressing

In the invention, it is preferable that a ratio of bias voltage whose polarity is identical to and opposite to the polarity of toner satisfies the relation of "0.3<bias voltage with polarity opposite to that of toner/bias voltage with polarity identical to that of toner≦1" during a certain period of non-transfer time of the transfer means, and it is more preferable that the ratio of bias voltage is set to satisfy the relation of "0.5<bias voltage with polarity opposite to that of toner/bias voltage with polarity identical to that of toner≦1".

3) Ratio of time in alternate voltage-impressing

In the invention, the following conditions are preferable for each of bias voltage whose polarity is opposite to and identical to the polarity of toner to be impressed once during a certain period of non-transfer time of the transfer means The relation of "time required for transfer roller to make 0.5 turns≦time required for bias with polarity opposite to or identical to that of toner to be impressed once≦time required for transfer roller to make 1.5 turns" is preferable. Further, the relation of "time required for transfer roller to make 0.7 turns≦time required for bias with polarity opposite to or identical to that of toner to be impressed once≦time required for transfer roller to make 1.3 turns" is more preferable.

Further, it is preferable that each of bias voltage with the same polarity and opposite polarity enter the following conditions.

The relation of "0.5≦time for impressing identical polarity/time for impressing opposite polarity≦2" is preferable and the more preferable is "0.7≦time for impressing identical polarity/time for impressing opposite polarity≦1.4". It is preferable that time for impressing identical polarity is almost the same as time for impressing opposite polarity.

4) Control of constant voltage and constant current

In the invention, it is preferable for the following reasons that bias voltage with polarity identical to that of toner is impressed at constant voltage, and bias voltage with polarity opposite to that of toner is impressed at constant current.

(1) A constant current power supply exists for performing transfer, and common use of bias for transfer and bias for cleaning both having the same polarity results in cost reduction.

(2) Since a constant voltage power supply is less expensive than a constant current power supply, cost reduction can be achieved by making bias with identical polarity of toner to be constant voltage.

(3) A combination of impression of bias voltage at constant voltage and that of bias voltage at constant current makes the design to be robust against fluctuation factors such as fluctuation in photoreceptors, fluctuation in toner and fluctuation in environmental conditions, and makes stable operation to be possible.

5) Frequency of switching bias voltage polarity

When the number of times of switching polarity of the power supply for voltage impression on rollers is less than 6, the transfer roller can not be cleaned sufficiently, causing toner contamination on the back side of a sheet in the following printing. However, when the number of times of switching is 20 or more, the roller requires more time than is needed to be cleaned. In addition, deterioration of electric characteristic of the transfer roller, variation of resistance values, in particular, is caused and excellent transferring can not be attained, which is a disadvantage.

The transfer roller of the invention can be applied also to an intermediate transfer drum in the same manner as in a photoreceptor drum.

Figure 11:
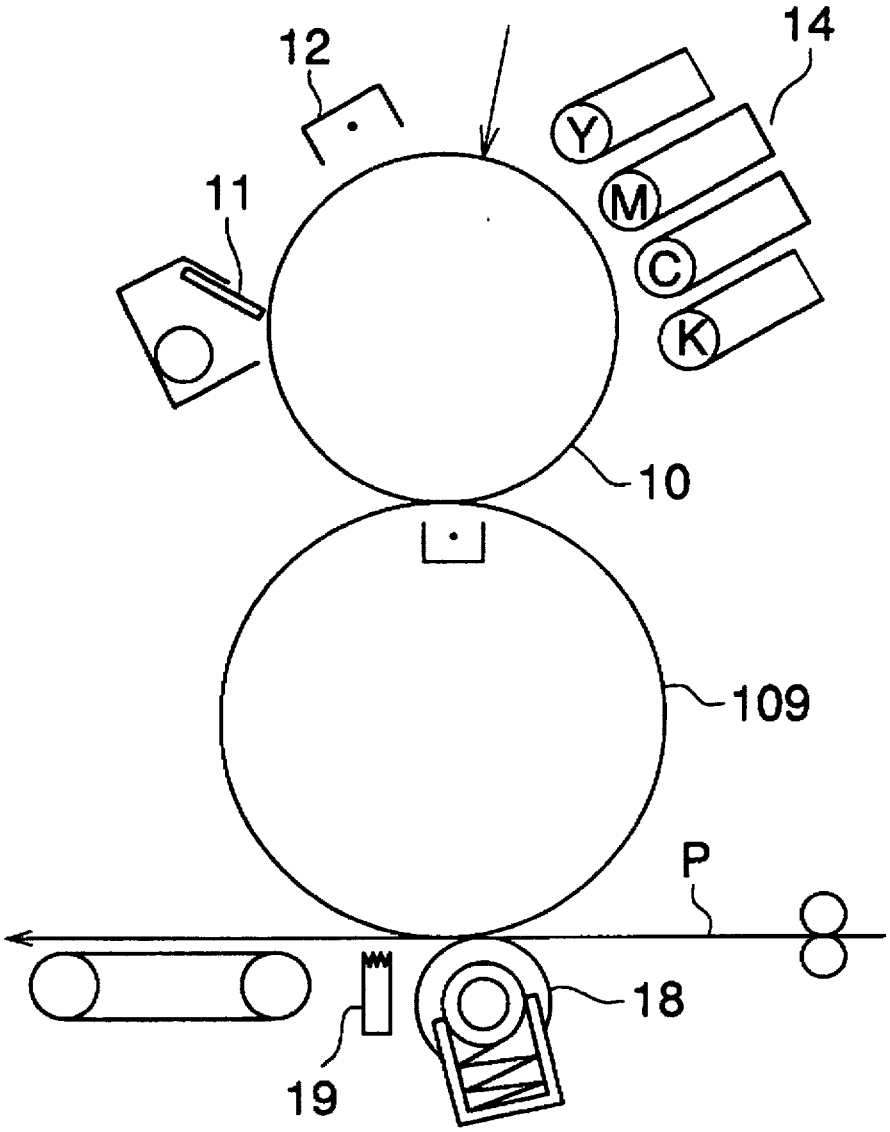
FIG. 11 is an illustration of an image forming apparatus employing an intermediate transfer object.

FIG. 11 represents the intermediate transfer object 10*a*, and when this intermediate transfer object 10*a* is used, an electrostatic latent image formed on rotated image carrier 10 is developed by charged toner in developing unit 14 to be a toner image which is transferred from the image carrier 10 to the intermediate transfer object 10*a*, and is further transferred electrostatically onto transfer sheet P fed from a sheet-feeding portion and is energized in the transfer section where the intermediate transfer object 10*a* and transfer roller 18 are brought into pressure contact each other, then the transfer sheet P is ejected.

As stated above, an image forming method and an image forming apparatus of the invention can offer great advantages that an amount of foreign materials sticking to a transfer means is small and cleaning can be done extremely easily and surely.

What is claimed is:

1. An apparatus for forming a multi-color image composed of at least two component colors on a sheet material, comprising:

an electrically chargeable photoconductor on which a toner image is formed, the photoconductor having a transfer section at which the toner image is transferred from the photoconductor to the sheet material, wherein the photoconductor is rotatable and has a radius of curvature larger than 40 mm at the transfer section;

image forming means comprising means for charging the photoconductor, means for imagewise exposing the charged photoconductor so as to form a latent image, means for developing the latent image so as to form a color toner image, the image forming means forming at least two component color toner images one after another on the photoconductor so that a latter color toner image is superimposed on a charged former color toner image on the charged photoconductor, wherein the toner images on the photoconductor have an electric polarity;

means for transferring the toner images onto the sheet material, the transferring means comprising a transferring roller whose surface is made of an elastic foamed material in which an average cell diameter is 1 μm to 300 μm, the transferring roller coming in contact with the sheet material and pressing the sheet material onto the photoconductor at the transfer section during a transferring operation so that the toner images are transferred at a time as the multi-color image onto the sheet material, and an electric bias member for applying an electric bias onto the transferring roller, wherein during the transferring operation, the electric bias member applies onto the transferring roller an opposite electric bias of a constant current having the opposite electric polarity to that of the toner image, and during a cleaning operation in which the transferring roller is brought in contact with the photoconductor at the transfer section so as to shift toner adhered on the transferring roller to the photoconductor, the electric bias member applies onto the transferring roller alternately an identical electric bias of a constant voltage having the identical electric polarity with that of the toner image and an opposite electric bias of a constant current having the opposite electric polarity to that of the toner image, six times or more.

2. The apparatus of claim 1, wherein the transferring member is brought into pressure contact with the image carrier by a force of 100–700 g/cm$^2$ during the cleaning operation.

3. The apparatus of claim 2, wherein the pressing force is 200–600 g/cm$^2$.

4. The apparatus of claim 1, further comprising an cleaning blade coming in contact with the image carrier, wherein the cleaning blade has elasticity and having hardness of 40°–90° stipulated by JIS K630 Stipulation A.

5. The apparatus of claim 1, wherein the average cell diameter is 20–200 μm.

6. The apparatus of claim 1, wherein, during the cleaning operation, the electric bias member applies the electric bias under the following condition:

0.3<(the voltage of the opposite electric bias / the voltage of the identical electric bias)≦1.

7. The apparatus of claim 6, wherein the electric bias is applied under the following condition:

0.5<(the voltage of the opposite electric bias / the voltage of the identical electric bias)≦1.

8. The apparatus of claim 1, wherein, during the cleaning operation, the electric bias member applies the electric bias under the following condition:

a time period required to make the transfer roller 0.5 turns≦a time period during which the identical electric bias or the opposite electric bias is applied one time≦a time period required to make the transfer roller 1.5 turns.

9. The apparatus of claim 8, wherein the electric bias is applied under the following condition:

a time period required to make the transfer roller 0.7 turns≦a time period during which the identical electric bias or the opposite electric bias is applied one time≦a time period required to make the transfer roller 1.3 turns.

10. The apparatus of claim 1, wherein an absolute voltage value of the identical electric bias and the opposite electric bias is 0.5 KV–3.5 KV.

11. The apparatus of claim 1, wherein during the cleaning operation, the electric bias member applies onto the transferring member alternately the identical electric bias and the opposite electric bias 6 to 20 times.

12. The apparatus of claim 1, wherein the transferring roller is brought in contact with the image carrier during the transferring operation and the transferring roller is separated from the image carrier while the toner images are formed.

* * * * *